United States Patent [19]

Butterworth et al.

[11] Patent Number: 4,786,421

[45] Date of Patent: Nov. 22, 1988

[54] FABRIC CONDITIONING COMPOSITION

[75] Inventors: Michael R. Butterworth, Schiedam, Netherlands; John Oakes, Cheshire, England

[73] Assignee: Lever Brothers Company, New York, N.Y.

[21] Appl. No.: 82,022

[22] Filed: Aug. 5, 1987

[30] Foreign Application Priority Data

Aug. 6, 1986 [GB] United Kingdom ..... 8619153

[51] Int. Cl.[4] ..... D06M 11/00

[52] U.S. Cl. ..... 252/8.8; 252/99; 8/137

[58] Field of Search ..... 252/8.8, 99; 8/137

[56] References Cited

U.S. PATENT DOCUMENTS

| | | | |
|---|---|---|---|
| 3,156,654 | 11/1964 | Konecny | 252/95 |
| 3,332,882 | 7/1967 | Blumbergs et al. | 252/186 |
| 3,442,692 | 5/1969 | Gaiser | 117/120 |
| 4,085,243 | 4/1978 | Giordano | 427/387 |
| 4,128,494 | 12/1978 | Schirmann et al. | 252/186 |
| 4,421,657 | 12/1983 | Allen | 252/8.6 |
| 4,460,487 | 7/1984 | Robinson | 252/8.8 |
| 4,578,200 | 3/1986 | Burckett | 252/8.8 |
| 4,622,154 | 11/1986 | Butterworth et al. | 252/8.8 |

FOREIGN PATENT DOCUMENTS

| | | |
|---|---|---|
| 844481 | 6/1970 | Canada . |
| 82563 | 6/1983 | European Pat. Off. . |
| 122141 | 4/1984 | European Pat. Off. . |
| 204484 | 12/1986 | European Pat. Off. . |
| 6921238 | 10/1969 | Japan . |
| 686344 | 9/1968 | South Africa . |
| 836988 | 6/1960 | United Kingdom . |
| 855735 | 12/1960 | United Kingdom . |
| 907356 | 10/1962 | United Kingdom . |
| 907358 | 10/1962 | United Kingdom . |
| 970950 | 9/1964 | United Kingdom . |
| 1003310 | 9/1965 | United Kingdom . |
| 1246339 | 9/1971 | United Kingdom . |
| 2150952 | 11/1976 | United Kingdom . |
| 1454504 | 11/1976 | United Kingdom . |
| 1550206 | 8/1979 | United Kingdom . |
| 2149316 | 11/1983 | United Kingdom . |
| 2122657 | 1/1984 | United Kingdom . |
| 2157729 | 4/1984 | United Kingdom . |
| 2157730 | 4/1984 | United Kingdom . |
| 2132655 | 7/1984 | United Kingdom . |
| 2132656 | 7/1984 | United Kingdom . |
| 2150951 | 7/1985 | United Kingdom . |

*Primary Examiner*—John F. Niebling
*Assistant Examiner*—Isabelle Rodriquez
*Attorney, Agent, or Firm*—Milton L. Honig; James J. Farrell

[57] ABSTRACT

An aqueous fabric conditioning composition comprises a fabric conditioner, such as a cationic fabric softener, optionally an electrolyte, selected from ionic salts of lithium, sodium, potassium, calcium, magnesium and aluminum, at levels up to 0.5% together with a compound containing a transition metal ion, such as Cobalt (II) ions. The transition metal ion enhances bleaching of fabrics when they are subsequently washed in a bleach-containing detergent composition.

2 Claims, No Drawings

FABRIC CONDITIONING COMPOSITION

The present invention relates to fabric conditioning compositions, in particular aqueous based fabric conditioning compositions.

It is known from, for example, GB No. 2 132 655 and GB No. 2 132 656 to form built detergent bleach compositions comprising a surface active agent, a peroxide compound and a heavy metal compound which comprises a transition metal ion, such as manganese.

In achieving the bleach catalysis disclosed in the above mentioned patents the transition metal ion is present in the bleach containing detergent composition. However, while catalytic bleaching is conveniently obtained under such conditions the efficiency of the process may be comparatively low due to complexation of the transition metal ion by components of the detergent composition and wasteful bleach decomposition in solution. It may, therefore, be desirable to seek a more efficient way of utilising the catalytic power of the transition metal ion without using washing compositions which contain transition metal compounds. The present invention seeks to overcome this problem.

It is known to treat fabrics with a fabric conditioning composition during the rinse step of a laundering process. Such compositions normally comprise a fabric conditioner.

We have now discovered that conditioning, together with catalysed bleaching in the subsequent wash can be achieved if a conditioning composition comprising a fabric conditioner and a compound containing a transition metal ion is added to the rinse step of a fabric laundering process.

Thus, according to the present invention there is provided a liquid fabric conditioning composition comprising a fabric conditioner, the composition being characterised in that it further comprises a compound containing a transition metal ion, selected from groups 4b–7b, 8 and 1b of the Periodic Table.

It is surprising that the catalytic activity of the transition metal ion is not inhibited by the usual components of fabric conditioning compositions and that it is not affected by ageing. Further, it is surprising that the metal ion is capable of catalysing bleaching of treated fabrics when they are subsequently washed in a detergent bleach composition.

The fabric conditioner used in the invention includes either a fabric softening agent, or an antistatic agent, or a mixture of such agents. Any well known cationic or nonionic fabric softening agent or antistatic agent can be used in the present invention, as well as mixtures of two or more such agents.

Highly preferred cationic materials are quaternary ammonium salts having the formula :

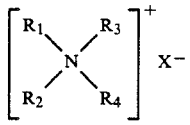

The cationic softening agents useful herein are quaternary ammonium salts wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride. Ditallow dimethyl ammonium chloride, di(hydrogenated tallow alkyl) dimethyl ammonium chloride, di(coconut alkyl) dimethyl ammonium chloride and di(coconut alkyl) dimethyl ammonium methosulfate are preferred.

The antistatic agents useful herein are quaternary ammonium salts wherein at least one, but not more than two, of $R_1$, $R_2$, $R_3$ and $R_4$ is an organic radical containing a group selected from a $C_{16}$–$C_{22}$ aliphatic radical, or an alkyl phenyl or alkyl benzyl radical having 10–16 atoms in the alkyl chain, the remaining group or groups being selected from hydrocarbyl groups containing from 1 to about 4 carbon atoms, or $C_2$–$C_4$ hydroxy alkyl groups and cyclic structures in which the nitrogen atom forms part of the ring, and Y is an anion such as halide, methylsulfate, or ethylsulfate.

Representative examples of quaternary ammonium antistatic agents include dicetyl dimethyl ammonium chloride; bis-docosyl dimethyl ammonium chloride; didodecyl dimethyl ammonium chloride; ditallow dimethyl ammonium bromide; ditallow dimethyl ammonium chloride; ditallow dipropyl ammonium bromide; ditallow dibutyl ammonium fluoride; cetyldecylmethylethyl ammonium chloride; bis-[ditallow dimethyl ammonium] sulfate; and tris-[ditallow dimethyl ammonium] phosphate. Dioctadecyldimethyl ammonium chloride and ditallow dimethyl ammonium chloride are preferred.

Another class of preferred cationic materials are the alkylimidazolinium salts believed to have the formula:

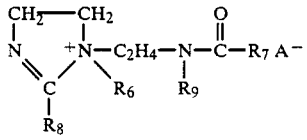

The cationic softening agents useful herein are imidazolinium compounds wherein $R_6$ is an alkyl or hydroxyalkyl group containing from 1 to 4, preferably 1 or 2 carbon atoms, $R_7$ is an alkyl or alkenyl group containing from 8 to 25 carbon atoms, $R_8$ is an alkyl or alkenyl group containing from 8 to 25 carbon atoms, and $R_9$ is hydrogen or an alkyl group containing from 1 to 4 carbon atoms and $A^-$ is an anion, preferably a halide, methosulfate or ethosulfate. Preferred imidazolinium salts include 1-methyl-l- (tallowylamido-) ethyl -2-tallowyl4,5-dihydro imidazolinium methosulfate and 1-methyl-1(palmitoylamido)ethyl -2-octadecyl-4,5- dihydroimidazolinium chloride. Other useful imidazolinium materials are 2-heptadecyl-l-methyl-1-(2-stearylamido)-ethyl-imidazolinium chloride and 2-lauryl-1-hydroxyethyl1-oleyl-imidazolinium chloride. Also suitable herein are the imidazolinium fabric softening components of U.S. Pat. No 4 127 489, incorporated by reference.

Suitable imidazolinium antistatic compounds include methyl-1-alkylamidoethyl-2-alkyl imidazolinium methyl sulfates, specifically 1-methyl-1-[(tallowamido)ethyl]-2-tallowimidazolinium methyl sulfate.

Typical nonionic fabric softening agents include the fatty acid esters of mono- or polyhydric alcohols, or anhydrides thereof, containing from 1 to 8 carbon atoms such as sorbitan esters including sorbitan monostearate, and sorbitan tristearate, ethylene glycol esters including ethylene glycol monostearate, glycerol esters including glycerol monostearate, alkyl mono- or di-alkanolamides such as palm or tallow mono ethanolamide and tallow di-ethanolamide, and other such materials disclosed in GB No. 1 550 206, the disclosure of which is incorporated herein by reference.

Alternative nonionic fabric softening agents include lanolin and lanolin-like materials such as acetylated lanolin.

Suitable nonionic antistatic agents include $C_{16}$–$C_{22}$ aliphatic alcohol ethoxylates having from 5 to 30 EO, i.e. 5 to 30 units of ethylene oxide per molecule.

The level of fabric conditioner material present in the composition of the invention is at least 0.5% by weight, most preferably between about 2% and about 25% by weight.

It is an essential feature of the present invention that the conditioning composition for use according to the present invention further comprises a transition metal containing compound. The transition metal is selected from groups 4b–7b, 8 and lb of the Periodic Table (CRC Handbook of Chemistry and Physics, 57th Edition). The transition metal ion is preferably one selected from the group comprising manganese, cobalt and copper. Any conventional counter ion is acceptable. Preferably the counter ion should not sequester the metal ion nor should it be susceptible to oxidation. The counter ion is more preferably chloride or nitrate, most preferably sulphate. Preferably, the level of transition metal ion is present in the composition in an amount from about 0.04% to about 2.0% by weight of the fabric conditioner material.

The fabric conditioning composition preferably comprises, in addition to the fabric conditioner and transition metal ion, a large volume of water.

The conditioning composition may also contain one or more optional ingredients selected from perfumes, perfume carriers, electrolyte materials, such as calcium chloride fluorescers, colourants, antiredeposition agents, viscosity control agents, such as the fatty acids, fatty acid esters and fatty alcohols, disclosed in copending patent application EP 122141, and low ethoxylated nonionics, disclosed in copending patent applications GB 85 09803 and GB 85 09804, enzymes, optical brightening agents, opacifiers, anti-shrinking agents, anti-wrinkle agents, fabric crisping agents, spotting agents, soil-release agents, germicides, fungicides, anti-oxidants, anti-corrosion agents, preservatives, dyes, and drape imparting agents.

In use, the fabrics are intended to be treated with a fabric conditioning composition according to the present invention and subsequently washed in a bleach containing detergent composition. The fabric conditioning composition is preferably added to the rinse cycle during washing in an automatic washing machine or it can be added to the rinse wate during hand washing.

The bleach containing detergent composition will usually comprise a peroxybleach compound in an amount from about 4% to about 50% by weight, preferably from about 10% to about 35% by weight. Typical examples of suitable peroxybleach compounds are alkali metal perborates, both tetrahydrates and monohydrates, alkali metal precarbonates and persilicates.

The detergent composition may also contain activators for peroxybleach compounds. These compounds have been amply described in the literature, including British Pat. Nos. 836 988, 855 735, 907 356, 907 358, 970 950, 1 003 310 and 1 246 339; U.S. Pat. Nos. 3 332 882 and 4 128 494; Canadian Pat. No. 844 481 and South African Pat. No. 68/6 344. Specific suitable activators include: tetraacetyl glycoluril and tetraacetyl ethylene diamine.

The detergent composition further usually comprises a synthetic detergent active material otherwise referred to herein simply as a detergent compound. The detergent compounds may be selected from anionic, nonionic, zwitterionic and amphoteric synthetic detergent active materials. Many suitable detergent compounds are commercially available and are fully described in the literature, for example in "Surface Active Agents and Detergents", Volumes I and II, by Schwartz, Perry and Berch.

The preferred detergent compounds which can be used are synthetic anionic and nonionic compounds. The former are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$ ) alcohols produced for example from tallow or coconut oil, sodium and potassium alyyl ($C_9$–$C_{20}$) benzene sulphonates, particularly sodium linear secondary alkyl ($C_{10}$-$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularl $C_{10}$–$C_{20}$ alpha-olefins, with $SO_3$ and then neutralising and hydrolysing the reaction product. The preferred anionic detergent compounds are sodium ($C_{11-C15}$) alkyl benzene sulphonates and sodium ($C_{16}$–$C_{18}$) alkyl sulphates.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally 5 to 25 EO, ie 5 to 25 units of ethylene oxide per molecule, the condensation products of aliphatic ($C_8$–$C_{18}$)

primary or secondary linear or branched alcohols with ethylene oxide, generally up to 40 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Mixtures of detergent compounds, for example mixed anionic or mixed anionic and nonionic compounds may be used in the detergent compositions, particularly in the latter case to provide controlled low sudsing properties. This is beneficial for compositions intended for use in suds-intolerant automatic washing machines.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds.

The detergent composition also usually contain from about 5% to about 90% of detergency builder. Suitable detergency builder salts can be of the inorganic or organic types, or mixtures thereof. Examples of suitable inorganic builders include alkali metal borates, silicates, ortho-phosphates, polyphosphates and carbonates. Examples of suitable organic builders include alkylsuccinates, nitrilotriacetates, alkylmalonates and citrates.

A further class of builder salt is the insoluble aluminosilicate type.

Other components/adjuncts commonly used in detergent compositions are for example soil-suspending or antideposition agents such as the water-soluble salts of carboxymethylcellulose, carboxyhydroxymethylcellulose, copolymers of maleic anhydride and vinyl ethers, and polyethylene glycols having a molecular weight of about 400 to 10,000. These can be used at levels of about 0.5% to about 10% by weight. Dyes, pigments, optical brighteners, perfumes, anti-caking agents, suds control agents and fillers can also be added in varying amounts as desired.

The invention is further illustrated by the following non-limiting Examples.

EXAMPLES

Pieces of bleach sensitive test cloth each weighing 3.5 g and measuring 15 cm×15 cm were individually immersed, for five minutes, in 100 mls of aqueous solutions made by diluting suitable amounts of fabric conditioning compositions according to the present invention. After the conditioning treatment each test cloth was wrung out and line dried. The reflectance of the dried cloth at 460 nm was measured using a Zeiss Elrepho reflectometer. The treated cloths were then washed for 30 minutes, at 40° C., in a liter of solution containing 5 grams a phosphate built detergent composition. The detergent composition contained 25% by weight of sodium percarbonate. The cloths were line dried and the reflectance was remeasured. The change in reflectance, ΔR, gives a measure of the bleaching effect.

EXAMPLE 1

The test cloths were immersed in a 100 ml of an aqueous solution prepared by diluting 0.175 g of a liquid fabric conditioning composition containing 4½% Arquad 2HT[1], and 0.025% cobalt sulphate. Control cloths were immersed in a 100mls of a solution made by diluting 0.175 g of a liquid fabric conditioning composition containing 4½% Arquad 2HT and 0.029% sodium sulphate. The bleaching effects were measured and the following results were obtained:

1—a commercially available form of dihardened tallow dimethyl ammonium chloride.

| Fabric Conditioner Composition | ppm metal ion deposited on the cloth (assuming 100% exhaustion from fabric conditioner composition) | Bleaching effect (ΔR) |
|---|---|---|
| 4½% Arquad 2HT 0.025% $CoSO_4$ | 4.7 | 7.01 |
| 4½% Arquad 2HT 0.029% $Na_2SO_4$ | 4.7 | 3.17 |

EXAMPLE 2

Cloths were immersed in a 100 mls of an aqueous solution prepared by diluting 0.058 g of a liquid fabric conditioning composition containing 10.9% Arquad 2HT, 2.6% hard tallow fatty acid and 0.075% cobalt sulphate. Control cloths were immersed in a 100 mls of a solution made by diluting 0.058 g of a liquid fabric conditioning composition containing 10.9% Arquad 2HT, 2.6% hard tallow fatty acid and 0.087% sodium sulphate. The bleaching effects were measured and the following results were obtained:

| Fabric Conditioner Composition | ppm metal ion deposited on the cloth (assuming 100% exhaustion from fabric conditioner composition) | Bleaching effect (ΔR) |
|---|---|---|
| 10.9% Arquad 2HT, 2.6% HT fatty acid + 0.075% $CoSO_4$ | 4.7 | 9.60 |
| 10.9% Arquad 2HT, 2.6% HT fatty acid + 0.087% $Na_2SO_4$ | 4.7 | 5.10 |

From the above data it is clear that an improvement in the bleaching of cloth is obtained when cloths are treated with a conditioner comprising Cobalt (II) metal ions during the rinse step of a fabric laundering process and before subsequent washing with a bleach containing detergent composition.

We claim:

1. A liquid fabric conditioning composition comprising from about 2 to about 25% of a fabric conditioner which is selected from the group consisting of alkylimidazolinium salts, quaternary ammonium salts having the formula:

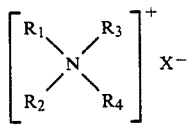

wherein $R_1$ and $R_2$ represent hydrocarbyl groups from about 12 to about 24 carbon atoms, $R_3$ and $R_4$ represent hydrocarbyl groups containing from 1 to about 4 carbon atoms, X is an anion, and mixtures of these salts, the composition being characterised in that it further comprises from about 0.04 to about 2.0% by weight based on the fabric conditioner of a compound containing a transition metal ion, selected from groups 4b–7b, 8 and 1b of the Periodic Table, said composition not containing a bleach.

2. A composition according to claim 1, characterised in that the transition metal ion is a cobalt ion.

* * * * *